US011542681B2

(12) United States Patent
Stander

(10) Patent No.: US 11,542,681 B2
(45) Date of Patent: Jan. 3, 2023

(54) SYSTEM AND METHOD FOR OPERATING A WORK MACHINE

(71) Applicant: Deere & Company, Moline, IL (US)

(72) Inventor: Francois Stander, Dubuque, IA (US)

(73) Assignee: Deere & Company, Moline, IL (US)

( * ) Notice: Subject to any disclaimer, the term of this patent is extended or adjusted under 35 U.S.C. 154(b) by 302 days.

(21) Appl. No.: 16/948,755

(22) Filed: Sep. 30, 2020

(65) Prior Publication Data

US 2022/0098828 A1 Mar. 31, 2022

(51) Int. Cl.
*E02F 9/20* (2006.01)
*E02F 9/26* (2006.01)

(52) U.S. Cl.
CPC ..... *E02F 9/2045* (2013.01); *E02F 9/2029* (2013.01); *E02F 9/262* (2013.01)

(58) Field of Classification Search
CPC ..... E02F 3/6463; E02F 3/651; E02F 9/2029; E02F 9/2045; E02F 9/262
See application file for complete search history.

(56) References Cited

U.S. PATENT DOCUMENTS

| | | | | |
|---|---|---|---|---|
| 3,477,152 | A | 11/1969 | Ask | |
| 9,885,169 | B2 | 2/2018 | Sharpe et al. | |
| 9,945,096 | B2 * | 4/2018 | Cherney | E02F 3/7618 |
| 10,066,367 | B1 * | 9/2018 | Wang | E02F 9/265 |
| 10,832,435 | B1 * | 11/2020 | Mathew | G06K 9/6215 |
| 11,001,991 | B2 * | 5/2021 | Ha | H04N 7/18 |
| 2014/0237868 | A1 | 8/2014 | Whitchurch et al. | |
| 2016/0289927 | A1 | 10/2016 | Wang et al. | |
| 2017/0226717 | A1 * | 8/2017 | Cherney | E02F 3/7618 |

FOREIGN PATENT DOCUMENTS

SU 1578278 A1 7/1990

* cited by examiner

*Primary Examiner* — Tyler J Lee

(57) ABSTRACT

A method and system of using real-time control for a work machine to determine strategies for operating the work machine is disclosed. The method may comprise accessing a real-time cutting time; accessing a first productivity rate, accessing a payload data; analyzing the cutting time; determining an operating strategy based at least on changes in the cutting time and the payload data; and either executing the operating strategy or notifying an operator to execute the operating strategy.

18 Claims, 4 Drawing Sheets

SYSTEM AND METHOD FOR OPERATING A WORK MACHINE

CROSS-REFERENCE TO RELATED APPLICATIONS

N/A

FIELD OF THE DISCLOSURE

The present disclosure relates to a system and method for operating a work machine, in particular work machines that are with a cutting edge, and either self-load or work in conjunction with a loading work machine. The present disclosure is particularly well suited for use with work machines having a scraper blade for dislodging material to be moved and a receptacle for transportation of the dislodged material.

BACKGROUND

Work machines with a blade having a cutting edge are commonly used to remove ground surface and transfer the removed ground surface from one location to another. Whether functioning in manual mode, automatic mode, or semi-automatic mode with such machinery, areas of improvement may include optimizing the operating strategy. Omitting an operating strategy may result in spending "too much time in the cut" and a diminishing fill rate as the receptacle becomes full. Current methods may be elementary. Current methods may include spending preset times in a cut and pulling out of the cut when material begins to spill over the sides of the work machine. Therein lies a need for a refined approach to operating the work machine in a work cycle.

SUMMARY

This summary is provided to introduce a selection of concepts that are further described below in the detailed description and accompanying drawings. This summary is not intended to identify key or essential features of the appended claims, nor is it intended to be used as an aid in determining the scope of the appended claims.

The present disclosure provides improvements associated with current methods and systems of operating strategies by enabling manual guidance, or automatic control of the work machine and minimizing operator training required. It is therefore an object of disclosure to provide a method and system of using real-time control of the work machine to determine strategies for operating the work machine.

The system may comprise of a blade coupled to the work machine wherein the blade includes a cutting edge for cutting the ground surface. The system may also include a blade actuator coupled to the work machine for adjusting engagement of the blade with the ground surface.

A payload sensor may be coupled to a receptacle of the work machine wherein the payload sensor generates payload data based on the payload in the receptacle. The system and method may also comprise of a controller adapted to do the following. The controller may access a real-time cutting time wherein the real-time cutting time is based on a real-time monitoring of engagement of the cutting edge with the ground surface. The controller may access a first productivity rate. The controller may access a payload data wherein the payload data is based on a real-time input from the payload sensor. The controller may then analyze the real-time cutting time, the first productivity rate, and the payload data. The controller may determine an operating strategy based at least on changes in the cutting time and the payload data wherein the operating strategy comprises determining a time to abort a cutting operation during a work cycle. Subsequently, the controller may execute the operating strategy or notify an operator to execute the operating strategy.

The first productivity rate may be based on a prior work cycle.

The first productivity rate may be based on an average of the prior work cycles.

The controller may be further adapted to determine a real-time productivity rate based on the payload data, a prior work cycle time, a prior cutting time, and the real-time cutting time.

The operating strategy may be further based on determining when the real-time productivity rate is less than the first productivity rate.

The work cycle may include a cutting segment, a loaded transport segment, an unloading segment, and an empty transport segment.

The work cycle may be based on a predetermined path.

The payload data may be derived from a volume sensor identifying one or more of a volume and a fill level of the payload in the receptable of the work machine.

The payload data may be derived from a weight sensor wherein the weight sensor identifies one or more of a weight or pressure of the payload in the receptacle of the work machine.

These and other features will become apparent from the following detailed description and accompanying drawings, wherein various features are shown and described by way of illustration. The present disclosure is capable of other and different configurations and its several details are capable of modification in various other respects, all without departing from the scope of the present disclosure. Accordingly, the detailed description and accompanying drawings are to be regarded as illustrative in nature and not as restrictive or limiting.

BRIEF DESCRIPTION OF THE DRAWINGS

The detailed description of the drawings refers to the accompanying figures in which.

DETAILED DESCRIPTION

Figure 1:
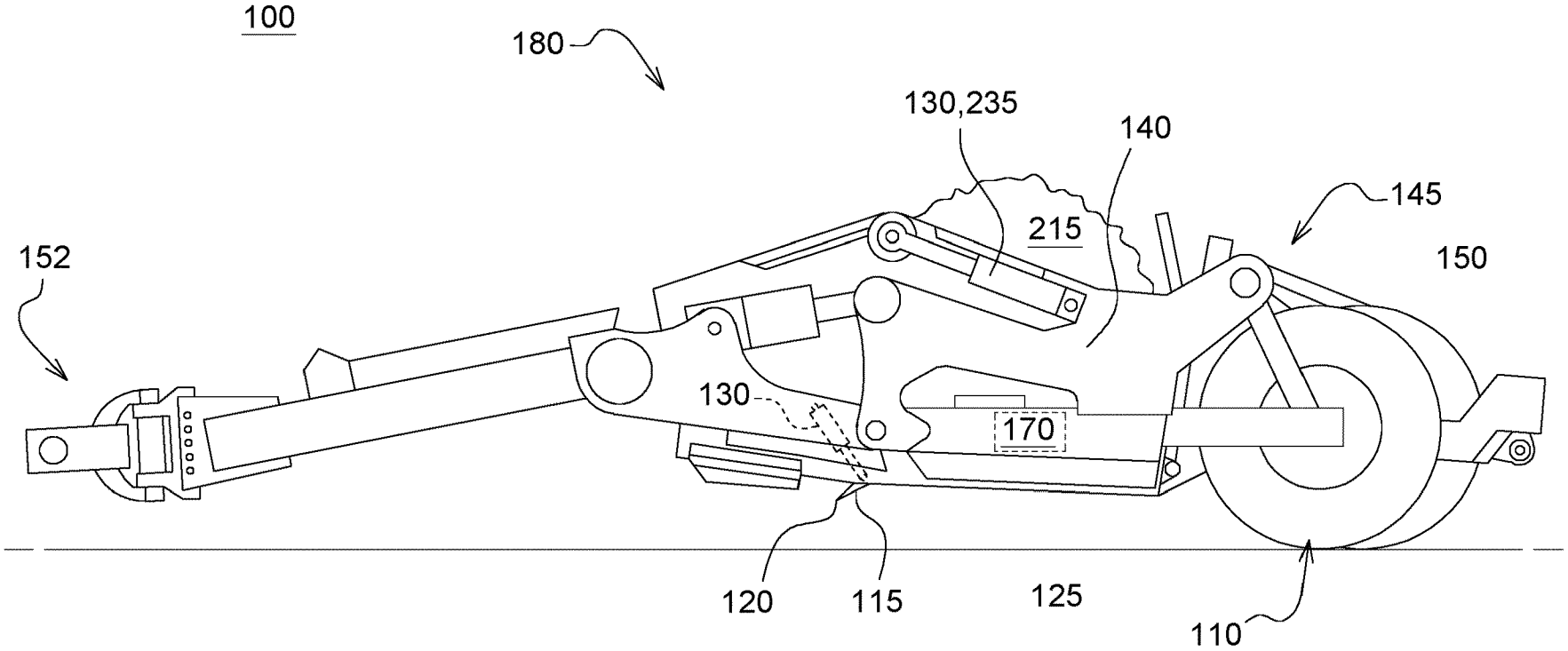
FIG. 1 is a side view of one embodiment of the work machine, or more specifically a scraper.

The embodiments disclosed in the above drawings and the following detailed description are not intended to be exhaustive or to limit the disclosure to these embodiments. Rather, there are several variations and modifications which may be made without departing from the scope of the present disclosure.

As used herein, unless otherwise limited or modified, lists with elements that are separated by conjunctive terms (e.g. "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g. A and B; B and C; A and C; or A, B, and C).

As used herein, the term controller refers to any hardware, software, firmware, electronic control component, processing logic, and/or processor device, individually or in any combination, including without limitation: application specific integrated circuit (ASIC), an electronic circuit, a processor (shared, dedicated, or group) and memory that executes one or more software or firmware programs, a combinational logic circuit, and/or other suitable components that provide the described functionality. Controller may also include components or combination of components for monitoring, recording, storing, indexing, processing, conditioning, and/or communicating operational aspects described below. Furthermore, although aspects of the present disclosure may be described generally as being stored in memory, one skilled in the art will appreciate that these aspects can be stored on or read from types of computer program products or computer readable media, such as computer chips and secondary storage devices or derived from a cloud. Controller may execute sequences of computer program instructions stored on the computer readable media to perform a method of using real-time control to determine strategies for operating a work machine, as described in detail later below.

Embodiments of the present disclosure may be described herein in terms of functional and/or logical block components and various processing steps. It should be appreciated that such block components may be realized by any number of hardware, software, and/or firmware components configured to perform the specified functions. For example, an embodiment of the present disclosure may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments of the present disclosure may be practiced in conjunction with any number of work machines, and that the scraper described herein is merely one exemplary embodiment of the present disclosure.

For the sake of brevity, conventional techniques related to signal processing, data transmission, signaling, control, and other functional aspects of the system (and the individual operating components of the systems) may not be described in detail herein. Furthermore, the connecting lines shown in the various figures contained herein are intended to represent example functional relationships and/or physical coupling between the various elements. It should be noted that many alternative or additional functional relationships or physical connections may be present in an embodiment of the present disclosure.

Discussion herein may be applicable to any type of work machine that is configured to cut, transport, and dump material in a known repeatable cutting cycle. For example, work machines in some embodiments may be configured to apply to any machine comprising a blade-type and receptacle type attachments. The work machine may further be configured as machines other than construction vehicles, including machines from agriculture, forestry and mining industries, such as tractors.

Figure 2:
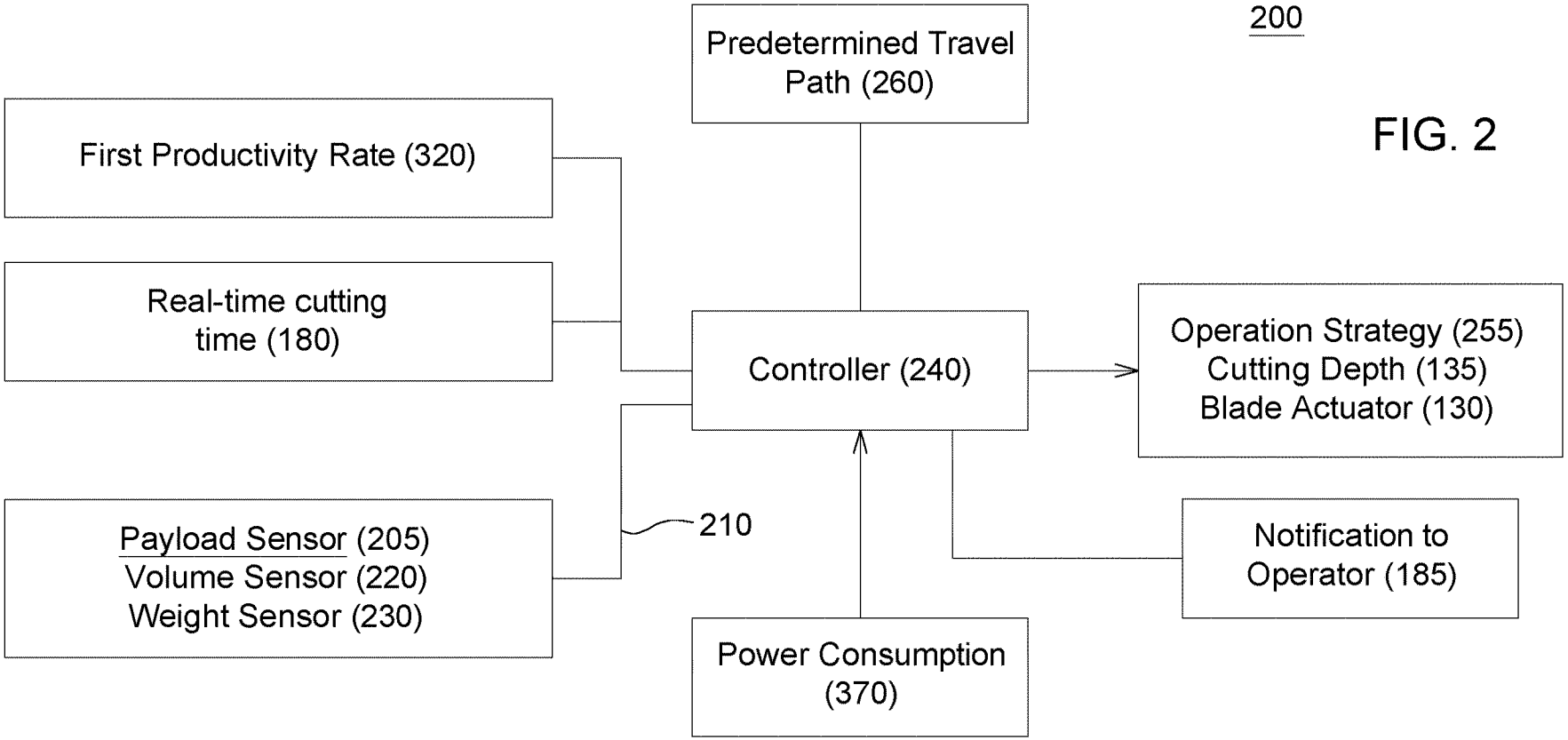
FIG. 2 is a schematic diagram of the work machine in FIG. 1.

Now referring to FIGS. 1 and 2 for the following description. FIG. 1 illustrates an exemplary work machine 100, known as a scraper. The scraper may be coupled to another work machine, such as a tractor (not shown) for towing. The scraper is adapted to cut (i.e. remove a ground surface), load, transport, and unload material to another location. The ground-engaging mechanism 110 shown are wheels. However, it is contemplated that the work machine 100 may be propelled or supported by way of wheels, continuous tracks, and/or belts, if desired. The work machine 100 may comprise of a blade 115 coupled to the work machine 100 and having a cutting edge 120 for scraping a ground surface 125 and a blade actuator 130 (shown inf FIG. 2) for adjusting engagement of the blade 115 with the ground surface 125. The work machine 100 may include a receptacle 140 operatively coupled to the blade 115 with the receptacle towed across the ground surface 125 as the ground surface is cut. Receptacle 140 may be a tool embodied as a generally hollow enclosure having an opening at front end. A blade 115 may be located at front end and positioned to selectively engage the ground surface 125 for material removal.

The work machine 100 may include multiple components that interact to power and control operations of the receptacle 140 and blade 115. Specifically, the work machine 100 may include a frame 145, a rear axle assembly 150, and an articulating hitch assembly 152. The frame 145 may be coupled to the rear axle assembly 150 and configured to support the receptacle 140. The articulating hitch assembly 152 may couple the frame 145 to a tractor, for example, towing the work machine 100 while allowing some relative movement in both the vertical and horizontal directions.

An operator cab (not shown) may include one or more interface devices located proximal to an operator seat and configured to generate control signals and/or present displays associated with operation of the work machine 100. In one example, the interface device may be used to display information regarding operation of the work machine 100, for example payload data 210 or a real-time productivity rate 325, as will be described in more detail below.

The receptacle 140 may be coupled to and supported by a rear axle assembly 150. During extension and retraction of receptacle actuators 235, receptacle 140 may be caused to pivot in the vertical direction about a rear axle assembly 150 such that a lead or front end 180 of receptacle may be raised and lowered relative to the ground surface 125. In the present embodiment, the blade actuator 140 and the receptacle actuator is the same. In some embodiments, a power source 170 may be contained near the receptacle 140 and supported by rear axle assembly 150. The power source 170 may be operated to drive rear axle assembly 150 and thereby push machine across the ground surface 125. Receptacle 140 may be a tool embodied as a generally hollow enclosure having an opening at front end 180. A blade 115 may be located near the front end 180 of receptacle and positioned to selectively engage the ground surface 125 as the front end 180 is lowered by one or more blade actuators 130.

A payload sensor 205 may be coupled to the receptacle 140 of the work machine 100. The payload sensor 205 may generate payload data 210 based on a payload in the receptacle 140. The payload data 210 may be derived from a volume sensor 220. The volume sensor 220 may identify one or more of a volume and a fill level of the payload in the receptacle 140 of the work machine 100. For example, an image capture device such as a camera, or lidar, or radar, may be mounted in or near the receptacle. The payload data 210 received may indicate if a maximum fill level is achieved. Alternatively, or in addition to, the payload data 210 may be derived from a weight sensor 230 (i.e. indirectly monitoring the payload 215). The weight sensor 230 may identify one or more of weight or pressure of the payload 215 in the receptacle 140 of the work machine 100. For example, in one embodiment of a weight sensor 230, receptacle actuators 235 to tip receptacle for dumping may be equipped with pressure sensors configured to sense hydraulic pressures of fluid within one or more different chambers of receptacle actuators 235 (e.g. a pressure sensor disposed within or otherwise fluidly connected to each pressure chamber of receptacle actuators) and to generate corresponding signals. The signal generated by pressure sensors may be indicative of forces acting on a receptacle 140. That is, the forces generated by weight of material from the payload 215 captured within the receptacle 140, may create a signal directed to the controller 240.

FIG. 2 is a schematic diagram of the system 200 using real-time control for a work machine 100.

A controller 240 coupled to the work machine 100 may be adapted to access a real-time cutting time 180 wherein the real-time cutting time 180 is based on a real-time monitoring of engagement of the cutting edge 120 with the ground surface 125. This may be derived from multiple ways. In one instance, the controller 240 may track time of when the payload changes. In another instance, the controller may track time the positioning of the blade actuator 130 where the blade actuator 130 enables to the blade 115 to engage the ground surface 125. The controller 240 may then be adapted access a first productivity rate 320 and access a payload data 210 wherein the payload data 210 is based on a real-time input from the payload sensor 205. The controller 240 may then analyze the real-time cutting time 180, the first productivity rate 320, and the payload data 210 to determine an operating strategy 255. The operating strategy 255 may comprise of determining a time to abort a cutting operation during a work cycle 302. This may also be interpreted as determining a time to disengage the cutting edge 120 of the blade 115 from the ground surface 125. Subsequently, the controller 240 may either execute the operating strategy 255 at the determined time or notify the operator 185 to execute the operating strategy at the determined time. Aborting the cutting operation 277 may be done either autonomously by automatically actuating the blade actuator 130, or simply be a notification 185 to the operator to abort the cutting operation by actuating the blade actuator 130.

The first productivity rate 320, also referred to as P1 may be based on a prior work cycle 302. That is the first productivity rate 320, or P1, may be based on the following equation:

$$\frac{\text{Payload data (210) from a prior cycle}}{\left(\begin{array}{c}\text{(prior work cycle (302) time)} - \\ \text{(prior time in cutting segment (330))}\end{array}\right)}$$

Note the payload data 210 from the prior work cycle is the accumulated payload from the prior work cycle 302. Alternatively, the first productivity rate 320 may be based on the average productivities from several prior work cycles. This may also been seen as an average of P1, P2, P3. etc. This may enable the controller 240 to identify any deviations from the norm in instances such as when the work machine is getting refueled, or the work machine becomes stuck and needs to be recovered, or downtime from a repair, to name a few.

The controller 240 may be further adapted to determine a real-time productivity rate 325 based on the payload data 210 in real-time, a prior work cycle time 302, a prior cutting time 330, and the real-time cutting time 180.

$$\frac{\text{Payload (215) in real} - \text{time}}{\left(\begin{array}{c}\text{(prior work cycle (302) time)} - \\ \text{(prior cutting time (330))} + \\ \text{(real} - \text{time cutting time (180))}\end{array}\right)}$$

The valued using the above-mentioned methodology will result in an upward trend in the real-time productivity rate 325 until it reaches a peak and begins to trend downwards. This may alternatively be described as when the operating strategy 255 is further based on determining when the real-time productivity rate 325 is less than the first productivity rate 320.

Figure 3:
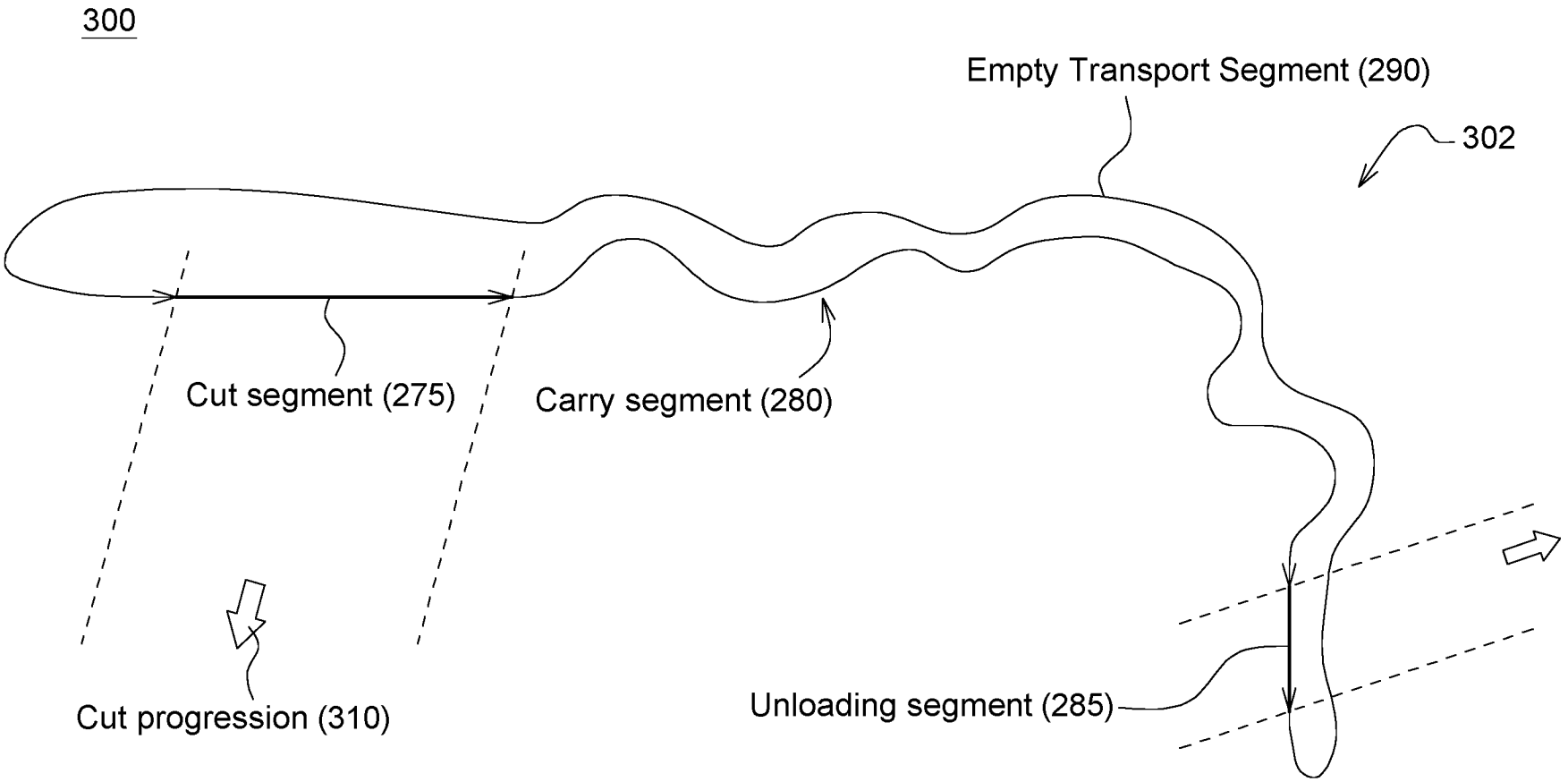
FIG. 3 is a schematic diagram of a worksite demonstrating the elements for the method of using real-time control for a work machine.

Now referring to FIG. 3, with continued reference to FIGS. 1 and 2, a schematic of a worksite 300 with an exemplary layout of a work cycle 302 is shown. A work cycle 302 may comprise of a cutting segment 275, a loaded transport segment 280, and unloading segment 285, an unloading segment 285, and an empty transport segment 290.

The work cycle 302 may be based on a predetermined path 260. If a path is predetermined, the unloading segment 285, and the empty transport segment 290 may already be known.

The operating strategy 255 of determining a time to abort a cutting operation (i.e. disengaging the cutting edge 120 with the ground surface 125) advantageously factors in changes in traction of the ground-engaging mechanism 110 caused by a changing payload 215. For example, as the work machine 100 moves forward in a cut segment 275, the cutting depth of the cutting edge 120 may increase, thereby increasing fill rate of payload 215 in the receptacle 140. The fill rate and/or fill volume may be monitored by the payload sensor 205. In the initial stages of a cutting segment 275 when the receptacle of the work machine 100 is empty, the work machine 100 therefore set to take a shallower cut (and therefore take in less payload 215). The cut progression 310, also referred to as the gradual changes in the cutting depth impacts the payload data 210 because the fill rate (volume and/or weight) of the payload 215 in the receptacle 140. As the payload 215 increases, traction improves, and a deeper cutting depth 135 can be made, which means the rate of payload 215 accumulation increases as derived from the payload data 210. Subsequently, payload 215 accumulation in the receptacle 140 may begin resisting the addition of more payload 215, thereby slowing down the rate of payload 215 accumulation and impacting the real-time productivity rate 325. Finally, if allowed to continue the cutting segment 275, the payload 215 may begin spilling over the sides of the receptacle 140, meaning the receptacle 140 has reached full capacity and may not take much more payload 215.

Figure 4:
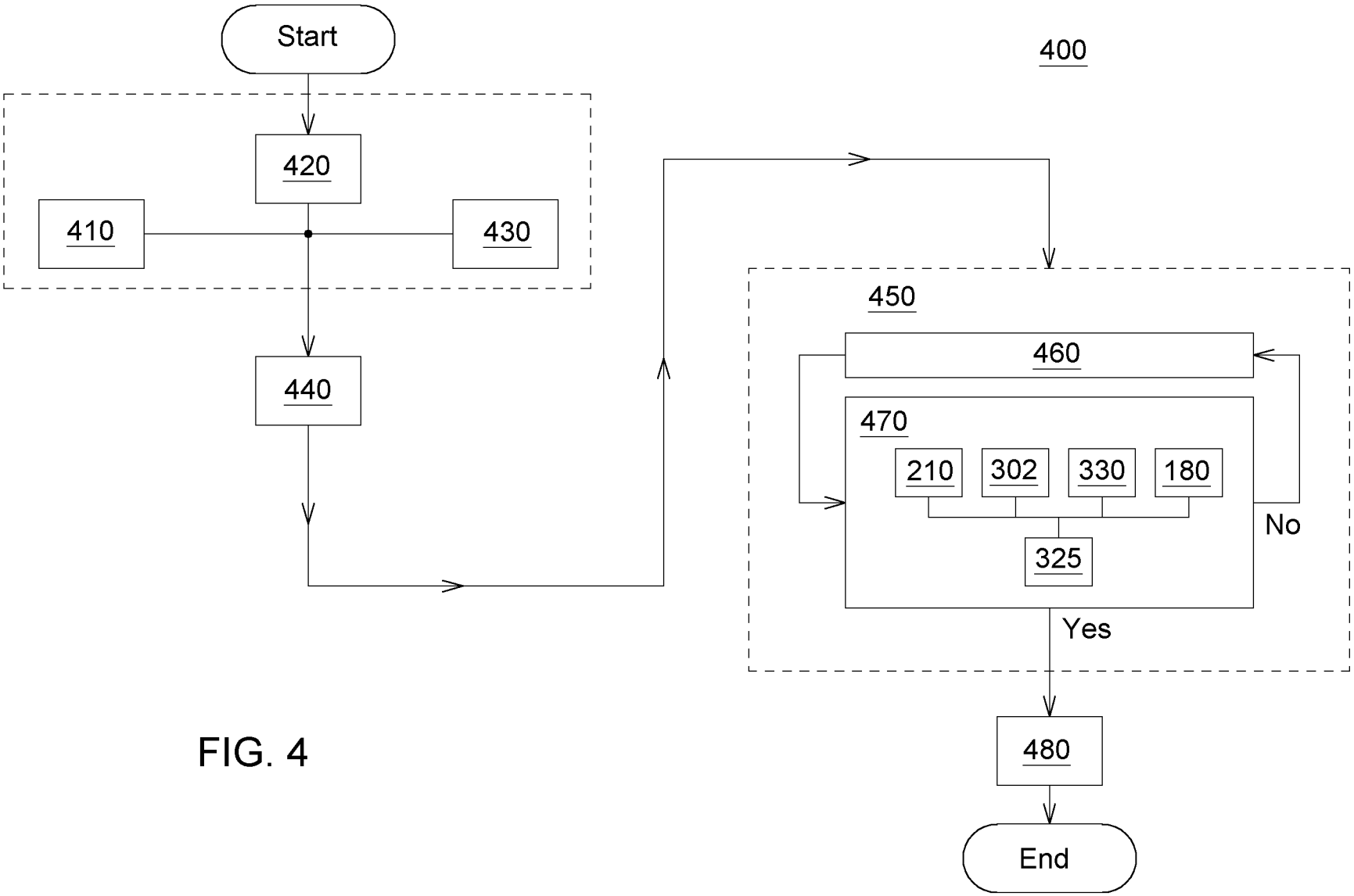
FIG. 4 is a flow chart for a method of using real-time control for a work machine to determine strategies for operating the work machine.

To demonstrate the industrial applicability, FIG. 4 is a flow chart for a method 400 of using real-time control for a work machine 100 to determine strategies for operating the work machine. In step 410, the controller 240 may access a real-time cutting time 180 wherein the real-time cutting time is based on a real-time monitoring of engagement of the cutting edge of a blade coupled to the work machine, with a ground surface. In step 420, the controller may access first productivity rate. In step 430, the controller 240 may access a payload data 210, wherein the payload data 210 is based on a real-time feed of payload 215 (volume or weight) into the receptacle 140 of the work machine 100. In step 440, the controller may analyze the cutting time, the productivity rate, and the payload data. In step 450, the controller 240 may determine an operating strategy 255 based at least on the real-time cutting time 180 and the payload data 210 wherein the operating strategy 255 includes determining a time to abort the operation in the cutting segment (275), also referred to as cutting operation 275, during a work cycle. In step 480, the controller 240 may finally execute the operating strategy 255 or notify the operator 185 to execute the operating strategy. Steps 460 and 470 demonstrate embodiments of the above-mentioned method wherein the analysis step 450 occurs.

Now turning to FIG. 5 with continued reference to FIG. 4, a detailed view of step 450 is shown. That is, in step 460, the controller 240 may analyze the real-time productivity rate 325 based on the payload data 210, the prior work cycle 302 time, a prior cutting time 330, and a real-time cutting time 180.

In step 470, the controller 240 may determine if the real-time productivity rate 325 is less than the first productivity rate 320. If yes, then the method moves to step 480. If no, then the method returns to step 460.

In application, a long loaded transport segment 280, for example, the method 400 may suggest the operator stay in a cutting operation 250 for 10 extra seconds, because a normalized productivity rate improvement occurs (e.g. two yards per hour) occurs. In a short loaded transport segment 280, for example, the method may suggest for the operator to pull out of the cutting segment 275 early because aborting the cutting operation at certain point will yield a one yard per hour advantage than remaining in the cutting operation 250 until the maximum fill level is reached. With the two types of measures, the operator may observe an advantage for one scenario, but not both.

The terminology used herein is for the purpose of describing particular embodiments or implementations and is not intended to be limiting of the disclosure. As used herein, the singular forms "a", "an" and "the" are intended to include the plural forms as well, unless the context clearly indicates otherwise. It will be further understood that the any use of the terms "has," "have," "having," "include," "includes," "including," "comprise," "comprises," "comprising," or the like, in this specification, identifies the presence of stated features, integers, steps, operations, elements, and/or components, but does not preclude the presence or addition of one or more other features, integers, steps, operations, elements, components, and/or groups thereof.

One or more of the steps or operations in any of the methods, processes, or systems discussed herein may be omitted, repeated, or re-ordered and are within the scope of the present disclosure.

While the above describes example embodiments of the present disclosure, these descriptions should not be viewed in a restrictive or limiting sense. Rather, there are several variations and modifications which may be made without departing from the scope of the appended claims.

What is claimed is:

1. A method of using real-time control for a work machine to determine strategies for operating the work machine, the method comprising:

accessing a real-time cutting time wherein the real-time cutting time is based on a real-time monitoring of engagement of a cutting edge of a blade coupled to the work machine, with a ground surface;

accessing a first productivity rate;

accessing a payload data, wherein the payload data is based on a real-time input of payload into a receptacle of the work machine;

analyzing the real-time cutting time, the first productivity rate, and the payload data;

determining an operating strategy based at least on changes in the real-time cutting time and the payload data wherein the operating strategy includes determining a time to abort a cutting operation during a work cycle; and at least one of executing the operating strategy and notifying an operator to execute the operating strategy.

2. The method of claim 1 wherein the first productivity rate is based on a prior work cycle.

3. The method of claim 1 wherein the first productivity rate is based on an average of prior work cycles.

4. The method of claim 1 further comprising:

determining a real-time productivity rate based on the payload data, a prior work cycle time, a prior cutting time, and the real-time cutting time.

5. The method of claim 4, wherein the operating strategy is further based on:

determining when the real-time productivity rate is less than the first productivity rate.

6. The method of claim 1, wherein the work cycle comprises:

a cutting segment, a loaded transport segment, an unloading segment, and an empty transport segment.

7. The method of claim 6, wherein the transport time is based on a predetermined path.

8. The method of claim 1, wherein the payload data is derived from a volume sensor, the volume sensor identifying one or more of a volume and a fill level of the payload in the receptacle of the work machine.

9. The method of claim 1, wherein the payload data is derived from a weight sensor, the weight sensor identifying one or more of a weight or pressure of the payload in the receptacle of the work machine.

10. A system using real-time control for a work machine, the system comprising:

a blade coupled to the work machine, the blade including a cutting edge for cutting a ground surface;

a blade actuator coupled to the work machine for adjusting engagement of the blade with the ground surface;

a payload sensor coupled to a receptacle of the work machine, the payload sensor generating a payload data based on a payload in the receptacle; and a controller adapted to:

access a real-time cutting time wherein the real-time cutting time is based on a real-time monitoring of engagement of the cutting edge with the ground surface;

access a first productivity rate;

access the payload data, wherein the payload data is based on a real-time input from the payload sensor;

analyze the real-time cutting time, the first productivity rate, and the payload data;

determine an operating strategy based at least on changes in the real-time cutting time and the payload data wherein the operating strategy comprises determining a time to abort a cutting operation during a work cycle; and at least one of execute the operating strategy and notify an operator to execute the operating strategy.

11. The system of claim 10, wherein the first productivity rate is based on a prior work cycle.

12. The system of claim 11, wherein the payload data is derived from a weight sensor, the weight sensor identifying one or more of a weight or pressure of the payload in the receptacle of the work machine.

13. The system of claim 10, wherein the first productivity rate is based on an average of prior work cycles.

14. The system of claim 10 wherein the controller is further adapted to:

determine a real-time productivity rate based on the payload data, a prior work cycle time, a prior cutting time, and the real-time cutting time.

15. The system of claim 10, wherein the operating strategy is further based on:

determining when a real-time productivity rate is less than the first productivity rate.

16. The system of claim 10, wherein the work cycle comprises:

a cutting segment, a loaded transport segment, an unloading segment, and an empty transport segment.

17. The system of claim 16, wherein the work cycle is based on a predetermined path.

18. The system of claim 10, wherein the payload data is derived from a volume sensor, the volume sensor identifying one or more of a volume and a fill level of the payload in the receptacle of the work machine.

* * * * *